US011717023B2

(12) United States Patent
Sakurai et al.

(10) Patent No.: US 11,717,023 B2
(45) Date of Patent: Aug. 8, 2023

(54) FILTERED SMOKING ARTICLE

(71) Applicant: JAPAN TOBACCO INC., Tokyo (JP)

(72) Inventors: Toru Sakurai, Tokyo (JP); Taku Hideshima, Tokyo (JP); Yusuke Kuromiya, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 362 days.

(21) Appl. No.: 16/912,194

(22) Filed: Jun. 25, 2020

(65) Prior Publication Data

US 2020/0323258 A1 Oct. 15, 2020

Related U.S. Application Data

(63) Continuation of application No. PCT/JP2017/046776, filed on Dec. 26, 2017.

(51) Int. Cl.

| | |
|---|---|
| ***A24D 1/02*** | (2006.01) |
| ***A24D 1/04*** | (2006.01) |
| ***D21H 27/08*** | (2006.01) |
| *D21H 17/37* | (2006.01) |

(52) U.S. Cl.

CPC ..... *A24D 1/025* (2013.01); *A24D 1/045* (2013.01); *D21H 27/08* (2013.01); *D21H 17/375* (2013.01)

(58) Field of Classification Search

None

See application file for complete search history.

(56) References Cited

U.S. PATENT DOCUMENTS

| | | | | |
|---|---|---|---|---|
| 5,284,166 | A * | 2/1994 | Cartwright | A24D 1/02 131/365 |
| 5,830,318 | A | 11/1998 | Snow et al. | |
| 5,921,249 | A * | 7/1999 | Hampl, Jr. | D21H 21/52 131/365 |
| 2003/0178039 | A1* | 9/2003 | White | A24D 1/02 131/365 |
| 2005/0000531 | A1* | 1/2005 | Shi | A24B 15/287 131/347 |
| 2006/0027243 | A1 | 2/2006 | Matsufuji et al. | |

(Continued)

FOREIGN PATENT DOCUMENTS

| | | |
|---|---|---|
| AU | 30696/77 A | 5/1979 |
| EP | 2 549 015 B1 | 9/2015 |

(Continued)

OTHER PUBLICATIONS

Rydholm, S., Pulping Processes, John Wiley $ Sons, 1965, pp. 51-52. (Year: 1965).*

(Continued)

*Primary Examiner* — Dennis R Cordray

(74) *Attorney, Agent, or Firm* — Birch, Stewart, Kolasch & Birch, LLP

(57) ABSTRACT

A filtered smoking article includes an aerosol generation rod, a filter disposed at a downstream end of the aerosol generation rod, and tipping paper wrapped around a downstream end part of the aerosol generation rod and an outer circumferential surface of the filter and connecting the aerosol generation rod and the filter. The tipping paper is paper containing bleached pulp and unbleached pulp, and fibers of the unbleached pulp have a length of 1 mm to 4 mm and a thickness of 20 μm to 70 μm.

8 Claims, 2 Drawing Sheets

(56) References Cited

U.S. PATENT DOCUMENTS

| | | | |
|---|---|---|---|
| 2007/0107864 | A1 | 5/2007 | Hahnle et al. |
| 2007/0193707 | A1 | 8/2007 | Nguyen |
| 2016/0007647 | A1 | 1/2016 | Nappi |

FOREIGN PATENT DOCUMENTS

| | | | |
|---|---|---|---|
| EP | 3 449 739 | A1 | 3/2019 |
| JP | 54-62400 | A | 5/1979 |
| JP | 2003-328299 | A | 11/2003 |
| JP | 2005-171411 | A | 6/2005 |
| JP | 4191273 | B2 | 12/2008 |
| JP | 2013-108197 | A | 6/2013 |
| JP | 2016-508377 | A | 3/2016 |
| RU | 2304913 | C2 | 8/2007 |
| RU | 2418125 | C2 | 5/2011 |
| RU | 2611268 | C2 | 2/2017 |
| WO | WO 2014/180521 | A1 | 11/2014 |
| WO | WO 2015/177907 | A1 | 11/2015 |
| WO | WO 2017/187628 | A1 | 11/2017 |

OTHER PUBLICATIONS

Rydholm, S., Pulping Processes, John Wiley $ Sons, 1965, pp. 47, 49. (Year: 1965).*

Office Action dated Dec. 23, 2020, in Russian Patent Application No. 2020128995/03(051848).

International Search Report (PCT/ISA/210) issued in PCT/JP2017/048778, dated Apr. 3, 2018.

Written Opinion of the International Searching Authority (PCT/ISA/237) issued in PCT/JP2017/046776, dated Apr. 3, 2018.

Office Action dated Sep. 3, 2021, in Canadian Patent Application No. 3,086,981.

* cited by examiner

FILTERED SMOKING ARTICLE

CROSS-REFERENCE TO RELATED APPLICATIONS

This application is a Continuation Application of PCT Application No. PCT/JP2017/046776, filed Dec. 26, 2017, the entire contents of which are incorporated herein by reference.

BACKGROUND OF THE INVENTION

1. Field of the Invention

The present invention relates generally to a filtered smoking article.

2. Description of the Related Art

A filtered smoking article, for example, a conventional filtered cigarette is formed of a filter and a cigarette rod which are integrated with each other. A filter material formed by bundling or folding non-woven fabrics containing cellulose acetate fibers or pulp is wrapped with a filter wrapper and formed in the shape of a rod, and the filter is thereby formed. Dried tobacco leaves are wrapped with cigarette paper and formed in the shape of a rod, and the cigarette rod is thereby formed. In a state where an end of the filter and an end of the cigarette rod are abutted against each other, tipping paper is wrapped over the entire circumference so as to bond the filter and the cigarette rod together, and the filter and the cigarette rod are thereby integrated with each other. At that time, the tipping paper is wrapped around a filter side end part of the cigarette rod and the filter and connects the cigarette rod and the filter.

Since tipping paper is a part to be held in the mouth and is one of parts related to the preference of a filtered cigarette, whiteness which gives a sense of cleanliness has been generally considered as important. Therefore, technologies for manufacturing tipping paper by decorating white tipping paper base paper have been considered. Examples of the decoration for the white tipping paper base paper are gravure printing, hologram printing and foil printing, and the decoration imparts preference to a filtered cigarette using a design which makes full use of the whiteness of the base paper, and the decoration also differentiates a product from others (for example, Patent Literature 1: WO 2015/177907 and Patent Literature 2: JP 2016-508377 A).

On the other hand, there is a design which appeals a sense of nature based on white base paper, and a simple example of the design is cork printing (for example, Patent Literature 3: JP 4191273 B).

BRIEF SUMMARY OF THE INVENTION

Tipping paper effective in imparting preference to a filtered cigarette other than white tipping paper is, for example, tipping paper having an appearance which gives a sense of cleanliness or nature. Although cork printing is a design currently widely used, cork printing is only an imitation and inevitably appears artificial. Even if a design other than cork printing is pursued from the perspective of improvement in texture, it is only a pattern engraved on a gravure cylinder which is seemingly irregular but is actually formed of repeated regular patterns, and it is difficult to give a sense of nature by the combination of white base paper and printing.

The present invention aims to provide a filtered smoking article including tipping paper having a texture giving a sense of nature which could not have been given by printing.

In general, according to one embodiment, there is provided a filtered smoking article including an aerosol generation rod, a filter disposed at a downstream end of the aerosol generation rod, and tipping paper wrapped around a downstream end part of the aerosol generation rod and an outer circumferential surface of the filter and connecting the aerosol generation rod and the filter. The tipping paper is paper containing bleached pulp and unbleached pulp, and fibers of the unbleached pulp have a length of 1 mm to 4 mm and a thickness of 20 μm to 70 μm.

The smoking article includes not only a cigarette but also a cigar and a cigarillo each of which generates smoke when an end of an aerosol generation rod including a cigarette rod is burned. The smoking article also includes a type of smoking article which generates a flavor component when an aerosol generation rod including a cigarette rod is heated without being burned. Examples of the method for heating without burning are a heating method using electric resistance, IH, chemical change or phase change, and the like.

As described above, the aerosol generation rod includes a cigarette rod formed of dried tobacco leaves wrapped with cigarette paper and formed in the shape of a rod. Alternatively, the aerosol generation rod includes a cigarette rod formed of dried tobacco leaves which are wrapped with a tobacco sheet, or a cigarette rod formed of a base material other than tobacco leaves which is impregnated with an aerosol source such as glycerin and a flavor component, is wrapped with paper and is formed in the shape of a rod. In all cases, the aerosol generation rod has a substantially cylindrical shape, and one end is abutted against the filter, is wrapped with tipping paper, and is connected to the filter.

The present invention can impart a sense of nature and preference to a filtered smoking article.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Some embodiments will be described hereinafter with reference to the accompanying drawings. The same structures will be denoted by the same references throughout the embodiments, and duplicate descriptions will be omitted. In addition, the drawings are schematic illustrations for facilitating understanding of the embodiments, and the shapes, dimensions, ratios and the like of the respective parts may be different from actual ones. In the present specification, terms "upstream" and "downstream" will be appropriately used with reference to a direction in which mainstream smoke flows when a filtered smoking article is smoked.

In the following embodiments, a filtered cigarette will be described as an example of the filtered smoking article.

First Embodiment

Figure 1:
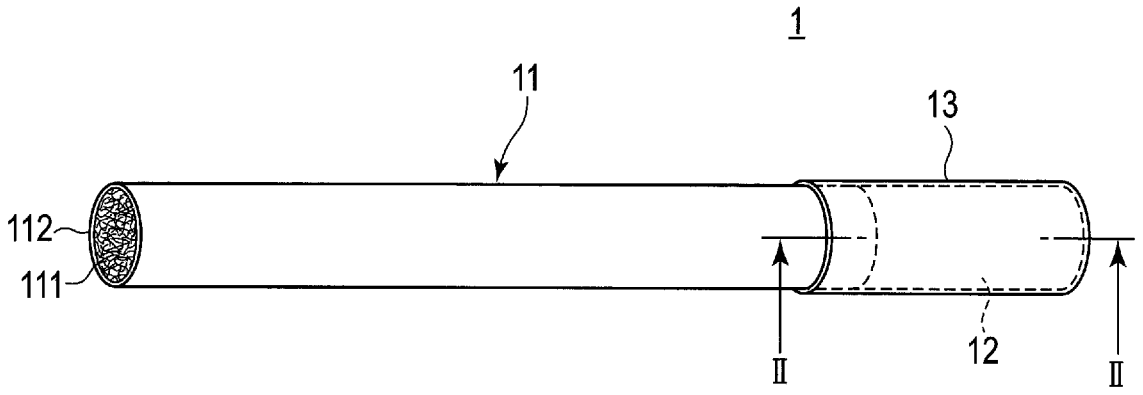
FIG. 1 is a schematic perspective view of a filtered cigarette according to the first embodiment.
Figure 2:
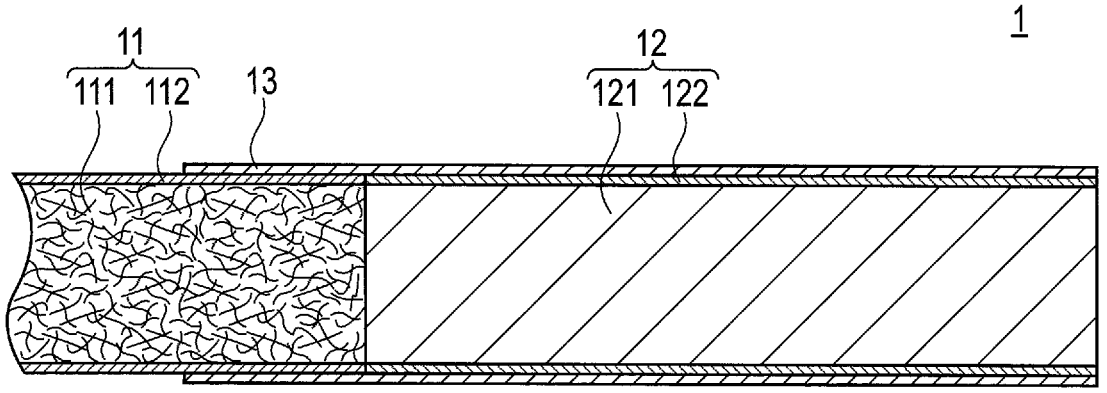
FIG. 2 is an enlarged schematic cross-sectional view taken along line II-II of FIG. 1.

FIG. 1 is a schematic perspective view of a filtered cigarette 1 according to the first embodiment. FIG. 2 is an enlarged schematic cross-sectional view taken along line II-II of FIG. 1. The filtered cigarette 1 includes an aerosol generation rod 11, a filter 12, and tipping paper 13.

The aerosol generation rod 11 is composed of, for example, cut tobacco 111 made of dried tobacco leaves and cigarette paper 112 wrapped around the cut tobacco 111, and has substantially a cylindrical shape. The cigarette paper 112 is, for example, air permeable paper.

The filter 12 is disposed at the downstream end of the aerosol generation rod 11. The filter 12 has the same or substantially the same diameter as the aerosol generation rod 11. The filter 12 is composed of a filter material 121 and a filter wrapper 112 wrapped around the filter material 121. The filter 12 is formed of a single filter material, that is, the filter 12 has a so-called plain filter structure.

The filter material 121 is formed by, for example, cellulose acetate fibers or bundling or folding non-woven fabrics of pulp.

The filter wrapper 122 is, for example, paper having a basis weight of 15 gsm to 100 gsm and a thickness of 30 μm to 100 μm. The air permeability of this paper is 0 CU to 30000 CU. The air permeability is a value measured in accordance with ISO 2965:2009, and is expressed as the flow rate ($cm^3$) of air passing through an area of 1 $cm^2$ per minute at a pressure difference between two sides of the paper of 1 kPa. 1 CORESTA unit (1 CU) is $cm^3/(min \cdot cm^2)$ at 1 kPa.

The tipping paper 13 is wrapped around the downstream end part of the aerosol generation rod 11 and the outer circumferential surface of the filter 12, and connects the aerosol generation rod 11 and the filter 12. The tipping paper 13 bonds the aerosol generation rod 11 and the filter 12 together by an adhesive such as glue. In addition, the tipping paper 13 is paper containing bleached pulp and unbleached pulp.

Unbleached pulp is colored pulp which is not bleached. The fibers of unbleached pulp have a length of 1 mm to 4 mm and a thickness of 20 μm to 70 μm, preferably, a length of 2 mm to 4 mm and a thickness of 30 μm to 70 μm. When the fibers of unbleached pulp contained in the tipping paper 13 have a length of 1 mm to 4 mm and a thickness of 20 μm to 70 μm, the smoker can visually recognize that unbleached pulp exists on the outer circumferential surface of the tipping paper 13. Therefore, the filtered cigarette 1 including the tipping paper 13 containing the fibers of unbleached pulp having a length of 1 mm to 4 mm and a thickness of 20 μm to 70 μm can make the smoker visually recognize a sense of nature.

With regard to the length and thickness of the fibers of unbleached pulp contained in the tipping paper 13, the surface of the tipping paper 13 was observed at a magnification of less than or equal to 100 times using a microscope, and the thicknesses and lengths of about 50 visible colored fibers were measured using an attached scale.

The ratio of unbleached pulp contained in the tipping paper 13 should preferably be, for example, greater than or equal to 1% by weight but less than or equal to 90% by weight, should more preferably be greater than or equal to 5% by weight but less than 86% by weight, and should most preferably be greater than or equal to 5% by weight but less than or equal to 60% by weight. Since the tipping paper 13 used in the embodiment contains not only bleached pulp but also unbleached pulp, as compared to a case where tipping paper contains only bleached pulp, the use of a bleaching agent at the time of manufacturing can be reduced, and the load on the environment can be reduced.

Bleached pulp is pulp which is bleached using a bleaching agent such as an oxidizing agent or a reducing agent. The length and thickness of the fibers of bleached pulp may be the same as or different from the length and thickness of the fibers of unbleached pulp and are not particularly limited.

In addition, the tipping paper 13 should preferably have lightness L* of 78 to 93, chromaticity a* of 0.6 to 2.8 and chromaticity b* of 7 to 18 in the CIELab colorimetric system. The lightness L*, the chromaticity a* and the chromaticity b* in the CIELab colorimetric system of the tipping paper 13 can be measured using a spectrophotometer (manufactured by X-Rite and named SpectroEye). The tipping paper 13 should more preferably have lightness L* of 80 to 92.5, chromaticity a* of 0.7 to 1.6 and chromaticity b* of 8 to 13 in the CIELab colorimetric system. The lightness L*, the chromaticity a* and the chromaticity b* in the CIELab colorimetric system of the tipping paper 13 can be controlled by adjusting the types of bleached pulp and unbleached pulp and the amount of unbleached pulp. Even when tipping paper has lightness L* within a range of 78 to 93, chromaticity a* within a range of 0.6 to 2.8 and the chromaticity b* within a range of 7 to 18 in the CIELab colorimetric system, if this tipping paper does not contain fibers of unbleached pulp having a length of 1 mm to 4 mm and a thickness of 20 μm to 70 μm, this tipping paper is simply colored paper. Therefore, a filtered cigarette including this tipping paper cannot make the smoker visually recognize a sense of nature.

As the bleached pulp, wood pulp can be used. As the unbleached pulp, wood pulp or non-wood pulp can be used.

The type of wood as the raw material of wood pulp is not particularly limited but should preferably be conifers such as cedar, hinoki, pine, fir and spruce and hardwoods such as eucalyptus, beech, oak and poplar.

Wood pulp can be manufactured by, for example, using the above-described wood, removing impurities and lignin from the wood as the raw material in a digestion process which is a chemical process such as the kraft process, and then performing a bleaching process and cleaning process. Wood pulp manufactured by the above-described kraft process is also called kraft pulp or chemical pulp, has high flexibility and contains few impurities, and should preferably be used as bleached pulp.

In addition, wood pulp can also be manufactured by, for example, using the above-described wood, removing impurities and lignin from the wood as the raw material in a digestion process, performing a bleaching process for a short time or without performing a bleaching process at all, and then performing a cleaning process. The wood pulp manufactured as described above contains fibers having the above-described length and thickness and can be used as unbleached pulp.

Unbleached pulp may contain, for example, non-wood pulp. The type of non-wood as the raw material of non-wood pulp is not particularly limited but should preferably be hemp, kenaf, flax, rice straw, wheat straw and the like.

In some cases, non-wood pulp contain a large number of fibers having a length or thickness exceeding the suitable length or thickness, spotty lumps and the like, in addition to fibers having the suitable length or thickness such as those described above. When tipping paper contains such undesired fibers and lumps, these fibers and lumps are likely to be recognized as foreign objects in appearance, and when a filtered cigarette includes this tipping paper, high preference may be impaired. Therefore, although unbleached pulp may contain non-wood pulp, unbleached pulp should preferably contain a large number of wood pulps or should more preferably be wood pulp.

The tipping paper 13 may be paper further containing calcium carbonate or titanium oxide as a filler and having opacity of greater than or equal to 76%. The tipping paper 13 having opacity of greater than or equal to 76% is obtained by containing, for example, calcium carbonate of greater than or equal to 20% by weight. The tipping paper 13 having opacity of greater than or equal to 76% is preferable because characters or figures printed on the front surface are not likely to be seen through on the back surface.

The filler is, for example, mineral powder mixed to paper and contains an inorganic or organic compound. The filler contains titanium oxide, calcined kaolin, kaolin, talc, acid clay, aluminum hydroxide, synthetic silica or the like, in addition to calcium carbonate. The tipping paper 13 may contain one or more other fillers, in addition to calcium carbonate and titanium oxide. By containing the above-described fillers in the tipping paper 13, it is possible to impart flame retardancy to the tipping paper without impairing the appearance which makes the fibers of unbleached pulp of the tipping paper visually recognizable. For example, by containing kaolin and aluminum hydroxide in the tipping paper 13, it is possible to impart flame retardancy to the tipping paper.

In addition, when tipping paper includes a hydrophobic coating agent layer formed on a base web surface containing wood pulp, calcium carbonate as a filler, and a wet strength agent, the tipping paper can impart excellent water resistance.

Examples of the wet strength agent are polyamide epichlorohydrin (PAE), polyethyleneimine, epoxidized polyamide and polyacrylamide.

Examples of the hydrophobic coating agent are nitrocellulose (NC) and colored hydrophobic ink containing a pigment suitable for gravure printing.

The tipping paper 13 should preferably have a tensile strength of, for example, greater than or equal to 26.0 N/15 mm. The tipping paper 13 having a tensile strength of greater than or equal to 26.0 N/15 mm can secure sufficient strength required for high-speed manufacturing of cigarettes. Therefore, when cigarettes are manufactured at high speed, tipping paper will not or will not likely to be damaged or torn while the tipping paper moves through each apparatus.

When the tipping paper 13 has a rough surface, characters and designs printed on the surface are likely to be faint, but a sense of nature can be enhanced by faint characters and designs. On the other hand, when tipping paper has a smooth surface, it is possible to print clear characters and designs on the surface without impairing a sense of nature. Therefore, the tipping paper 13 can have a wide range of smoothness of greater than or equal to 5 seconds but less than or equal to 300 seconds. Note that an environmentally-conscious ink, for example, a vegetable-oil-based ink can be used for the printing on the tipping paper 13.

The above-described tipping paper can be manufactured by, for example, the following method.

Firstly, spruce which is a conifer and poplar which is a hardwood are prepared as bleached pulp, and pine is prepared as unbleached pulp. Bleached pulp and unbleached pulp are charged into a pulper at a desired ratio and are defiberized. Next, these defiberized pulps are transferred to a refiner and are beaten in the refiner. Separately, calcium carbonate as a filler and a flocculating agent as a manufacturing aid are prepared, and these are mixed with the beaten pulps. Note that bleached pulp and unbleached pulp may be individually defiberized using multiple pulpers and beaten in refiners, and these individually-beaten bleached pulp and unbleached pulp, the filler and the manufacturing aid may be mixed together in a mixing box.

Next, in a papermaking process using a Fourdrinier paper machine, a cylinder paper machine, a short cylinder combination paper machine, or the like, these mixed pulps are adjusted in texture and uniformized, and tipping paper is thereby manufactured. In the papermaking process, it is possible to adjust the printing condition of tipping paper by adding a bleeding inhibitor such as alkyl ketene dimer (AKD) or impart water resistance to tipping paper by adding a wet strength agent.

Second Embodiment

Figure 3:
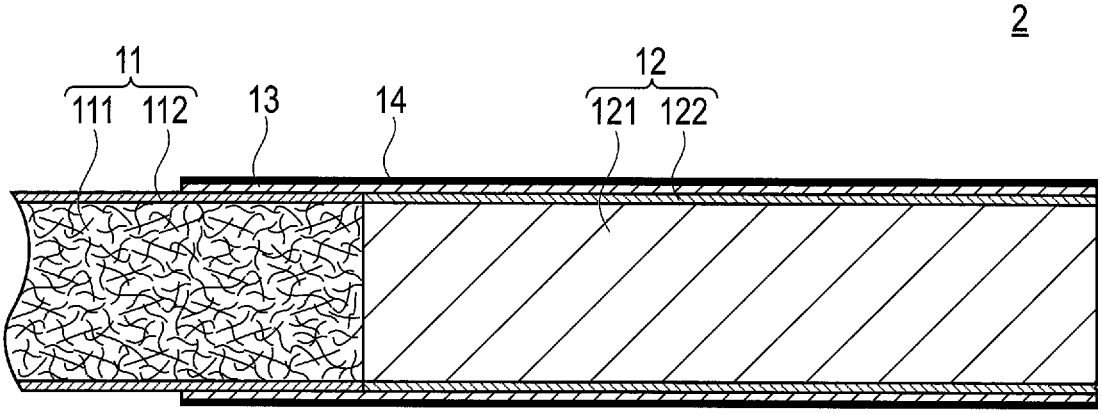
FIG. 3 is an enlarged schematic cross-sectional view showing a part of a filtered cigarette according of the second embodiment.

FIG. 3 is an enlarged schematic cross-sectional view showing part of a filtered cigarette 2 according to the second embodiment. The filtered cigarette 2 according to the second embodiment has the same structure as the filtered cigarette 1 according to the first embodiment, except that varnish 14 exists on the outer circumferential side of the tipping paper 13.

The varnish 14 soaks into the tipping paper 13 and also exists within the tipping paper 13. As the varnish, for example, nitrocellulose, ethyl cellulose, carboxymethyl cellulose and the like may be used.

Since the varnish 14 exists on the outer circumferential side of the tipping paper 13, the filtered cigarette 2 has not only the advantages described in the first embodiment but also the following advantage. That is, degradation in flavor caused by lignin and other impurities derived from unbleached pulp included in the tipping paper 13 can be suppressed or prevented. In addition, since the varnish 14 exists on the outer circumferential side of the tipping paper 13, the filtered cigarette 2 also has the following advantage. That is, the lip releasability of the tipping paper 13 at a time when the filtered cigarette 2 is smoked can be improved.

Note that the filtered cigarette according to each of the above-described embodiments may have another structure. For example, a plurality of holes (ventilation holes) penetrating the tipping paper and reaching the filter may be formed. These ventilation holes have the function of supplying air from the outside into the filter.

In addition, the filter shape can be any type of filter shape and may be a dual filter or a triple filter.

Examples of the present invention will be described below in detail.

Examples 1 to 8 and Comparative Examples 1 and 2

Tipping paper of each of Examples 1 to 8 was prepared by mixing bleached pulp and unbleached pulp together at each of ratios shown in Table 1 below. Note that unbleached pulp contains fibers having a length of 1 mm to 4 mm and a thickness of 20 μm to 70 μm.

In addition, so-called white tipping paper containing only bleached pulp without unbleached pulp was prepared as tipping paper of Comparative Example 1.

Furthermore, tipping paper of Comparative Example 2 was prepared by performing cork printing on the surface of the white tipping paper of Comparative Example 1. Note that the cork printing is gravure printing of a pattern imitating natural cork, and is widely and generally used for cigarettes.

The lightness L*, the chromaticity a* and the chromaticity b* in the CIELab colorimetric system of the tipping paper of each of Examples 1 to 8 and Comparative Examples 1 and 2 was measured using a spectrophotometer (manufactured by X-Rite and named SpectroEye). One sample was placed on paper having ISO whiteness of 92% under the condition of a light source D65, no light source filter and a viewing angle of 2°, the spectrophotometer was pressed on the sample, and measurement was thereby performed. In addition, 5 points were measured by changing the part of tipping paper each time, and the average of 5 points was calculated. The results are shown in Table 1 below.

Next, a filtered cigarette having the structure shown in FIG. 2 was manufactured using the tipping paper of each of Examples 1 to 5 and Comparative Example 1.

In addition, gravure printing of varnish made of nitrocellulose was performed on the outer circumferential surface of the tipping paper of each of Examples 6 to 8 and Comparative Example 2, and a filtered cigarette having the structure shown in FIG. 3 was manufactured using the tipping paper.

Twenty filtered cigarettes were manufactured for the filtered cigarette including the tipping paper of each of Examples 1 to 8 and Comparative Examples 1 and 2, and were stored in an environment of a temperature of 22° C. and a relative humidity of 60% for 10 days.

Evaluations (1) to (4) which will be described below were performed on the filtered cigarettes of Examples 1 to 8 and Comparative Examples 1 and 2.

<Evaluation (1): Sensory Evaluation of Appearance (Visibility of Unbleached Pulp Fibers)>

The sensory evaluation of the visibility of unbleached pulp fibers was performed as follow. That is, the filtered cigarette including the tipping paper of each of Examples 1 to 8 and Comparative Examples 1 and 2 was placed on a table on which white paper was spread, and was visually inspected by twenty panels. The visibility was ranked as "A" when all twenty panels could visually recognize unbleached pulp fibers at a glance, and the visibility was ranked as "B" when at least one panel cannot visually recognize unbleached pulp fibers.

<Evaluation (2): Sensory Evaluation of Appearance (Sense of Nature)>

The sensory evaluation of the sense of nature was performed as follows. That is, as is the case with the sensory evaluation of Evaluation (1), the filtered cigarette including the tipping paper of each of Examples 1 to 8 and Comparative Examples 1 and 2 was placed on a table on which white paper was spread, and was visually inspected by twenty panels. The sense of nature was scored 3 points when the sense of nature was clearly felt, the sense of nature was scored 2 points when the sense of nature was moderately felt, the sense of nature was scored 1 point when the sense of nature was slightly felt, and the sense of nature was scored 0 points when the sense of nature was not felt at all. The sense of nature was ranked as "A" when the average of twenty panels was greater than 2 points (high sense of nature), the sense of nature was ranked as "B" when the average of twenty panels was to 2 points (relatively high sense of nature), and the sense of nature was ranked as "C" when the average of twenty panels was less than 1 point (low sense of nature).

<Evaluation (3): Sensory Evaluation of Appearance (Preference)>

The sensory evaluation of preference was performed as follows. That is, as is the case with the sensory evaluations of Evaluations (1) and (2), the filtered cigarette including the tipping paper of each of Examples 1 to 8 and Comparative Examples 1 and 2 was placed on a table on which white paper was spread, and was visually inspected by twenty panels. The preference was scored 3 points when a panel clearly felt like smoking, the preference was scored 2 points when a panel moderately felt like smoking, the preference was scored 1 point when a panel slightly felt like smoking, and the preference was scored 0 points when a panel did not feel like smoking at all. The preference was ranked as "A" when the average of twenty panels was greater than 2 points (high preference), the preference was ranked "B" when the average of twenty panels was 1 to 2 points (relatively high preference), and the preference was ranked as "C" when the average of twenty panels was less than 1 point (low preference).

<Evaluation (4): Sensory Evaluation of Flavor>

The sensory evaluation of flavor was performed as follows. That is, the filtered cigarette including the tipping paper of each of Examples 1 to 8 and Comparative Examples 1 and 2 was actually smoked by five panels. The filtered cigarette including the tipping paper of Comparative Example 1 was used as a reference. The flavor was scored as 0 points when there was no difference in flavor from Comparative Example 1, the flavor was scored as 1 point when the flavor was slightly inferior to Comparative Example 1, the flavor was scored as 2 point when the flavor was moderately inferior to Comparative Example 1, and the flavor was scored 3 points when the flavor was clearly inferior to Comparative Example 1. The flavor was ranked as "A" when the average of five panels was less than 1 point (there was little difference in flavor from Comparative Example 1), the flavor was ranked as "B" when the average of five panels was 1 to 2 points (there was a moderate difference in flavor from Comparative Example 1), and the flavor was ranked as "C" when the average of five panels was greater than 2 points (there was a large difference in flavor from Comparative Example 1).

The evaluation results are shown in Table 1 below.

TABLE 1

| | Tipping Paper | | | | | | Evaluation | | | |
|---|---|---|---|---|---|---|---|---|---|---|
| | Structure | | | CIELab Colorimetric System | | | (1) | (2) | | |
| | Bleached Pulp/wt % | Unbleached Pulp/wt % | Varnish | Lightness L* | Chromaticity a* | Chromaticity b* | Visibility of Fibers | Sense of Nature | (3) Preference | (4) Flavor |
| Example 1 | 99 | 1 | Without | 92.8 | 0.6 | 7.5 | A | B | A | A |
| Example 2 | 95 | 5 | Without | 92.2 | 0.7 | 8.0 | A | A | A | A |
| Example 3 | 87 | 13 | Without | 91.0 | 1.0 | 8.9 | A | A | A | B |

TABLE 1-continued

| | Tipping Paper | | | | | | Evaluation | | | |
|---|---|---|---|---|---|---|---|---|---|---|
| | Structure | | | CIELab Colorimetric System | | | (1) | (2) | | |
| | Bleached Pulp/wt % | Unbleached Pulp/wt % | Varnish | Lightness L* | Chromaticity a* | Chromaticity b* | Visibility of Fibers | Sense of Nature | (3) Preference | (4) Flavor |
| Example 4 | 59 | 41 | Without | 86.4 | 1.6 | 12.1 | A | A | A | B |
| Example 5 | 14 | 86 | Without | 79.3 | 2.8 | 17.2 | A | B | B | C |
| Example 6 | 87 | 13 | With | 91.0 | 1.0 | 8.9 | A | A | A | A |
| Example 7 | 59 | 41 | With | 86.4 | 1.6 | 12.1 | A | A | A | A |
| Example 8 | 14 | 86 | With | 79.3 | 2.8 | 17.2 | A | B | B | B |
| Comparative Example 1 | 100 | 0 | Without | 93.0 | 0.6 | 7.4 | B | C | A | — |
| Comparative Example 2 | 100 | 0 | With | 64.2 | 19.1 | 38.6 | B | C | A | A |

As is clear from the results of Evaluation (1) in Table 1, it was confirmed that, in the filtered cigarette including the tipping paper of each of Examples 1 to 8 including unbleached pulp of greater than or equal to 1% by weight containing fibers having a length of 1 mm to 4 mm and a thickness of 20 μm to 70 μm, unbleached pulp fibers were visually recognizable at a glance.

As is clear from the results of Evaluation (2) in Table 1, it was confirmed that the filtered cigarette including the tipping paper of each of Examples 1 to 8 including unbleached pulp containing fibers having a length of 1 mm to 4 mm and a thickness of 20 μm to 70 μm gave a sense of nature to a panel (for example, a smoker) as compared to the filtered cigarette including the tipping paper of each of Comparative Examples 1 and 2 which did not include unbleached pulp.

As is clear from the results of Evaluation (3) in Table 1, it was confirmed that the filtered cigarette including the tipping paper of each of Examples 5 and 8 including unbleached pulp of 86% by weight had relatively high preference and the filtered cigarette including the tipping paper of each of Examples 1 to 4, 6 and 7 and Comparative Examples 1 and 2 had higher preference. The filtered cigarette including the tipping paper including unbleached pulp of greater than 86% by weight maintains a sense of nature but may remind a panel to oldness and cheapness from its dark color, and the preference may be reduced.

As is clear from the results of Evaluation (4) in Table 1, it was confirmed that, as compared to the filtered cigarette including the tipping paper of each of Examples 3 to 5, the filtered cigarette including the tipping paper of each of Examples 6 to 8 having varnish on the outer circumferential surface was improved in flavor, respectively.

As described above, in the sensory evaluations, the filtered cigarette including the tipping paper of each of Examples 1 to 8 has proven to have a sense of nature and preference which cannot be obtained from the filtered cigarette including the white tipping paper of Comparative Example 1 and the filtered cigarette including the cork-printed tipping paper of Comparative Example 2.

Although a filtered cigarette has been described as an example of the filtered smoking article in the above-described embodiments, the filtered smoking article is not limited to this but may be another smoking article to which a filter is connected, such as a cigar, a cigarillo, a non-combustion type smoking article using electric heating/chemical reaction heat or a non-heating type smoking article.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filtered smoking article comprising:

an aerosol generation rod;

a filter disposed at a downstream end of the aerosol generation rod; and tipping paper wrapped around a downstream end part of the aerosol generation rod and an outer circumferential surface of the filter and connecting the aerosol generation rod and the filter, wherein the tipping paper is paper containing bleached pulp and unbleached pulp, fibers of the unbleached pulp have a length of 1 mm to 4 mm and a thickness of 20 μm to 70 μm, and the tipping paper has lightness L* of 80 to 92.5, chromaticity a* of 0.7 to 1.6 and chromaticity b* of 8 to 13 in a CIELab colorimetric system.

2. The filtered smoking article of claim 1, wherein the bleached pulp is wood pulp and the unbleached pulp is wood pulp or non-wood pulp.

3. The filtered smoking article of claim 1, wherein the bleached pulp and the unbleached pulp are wood pulp.

4. The filtered smoking article of claim 1, wherein the tipping paper is paper further containing calcium carbonate or titanium oxide as a filler and having opacity of greater than or equal to 76%.

5. The filtered smoking article of claim 1, wherein varnish exists on an outer circumferential side of the tipping paper.

6. The filtered smoking article of claim 1, wherein the tipping paper has a tensile strength of greater than or equal to 26.0 N/15 mm.

7. The filtered smoking article of claim 1, wherein an amount of the unbleached pulp contained in the tipping paper is 1% by weight or more based on a total amount of the unbleached pulp and the bleached pulp contained in the tipping paper.

8. The filtered smoking article of claim 1, wherein an amount of the unbleached pulp contained in the tipping paper is 1% by weight to 90% based on a total amount of the unbleached pulp and the bleached pulp contained in the tipping paper.

* * * * *